United States Patent [19]

Dechirot

[11] Patent Number: 4,821,894

[45] Date of Patent: Apr. 18, 1989

[54] RETURN SPRING DEVICE FOR DOUBLE PINS OF DISPLAY UNITS

[75] Inventor: Jean-Pierre Dechirot, Sedan, France

[73] Assignee: Societe Vynex S.A., Flize, France

[21] Appl. No.: 112,833

[22] PCT Filed: Jan. 12, 1987

[86] PCT No.: PCT/FR87/00007

§ 371 Date: Sep. 25, 1987

§ 102(e) Date: Sep. 25, 1987

[87] PCT Pub. No.: WO87/04328

PCT Pub. Date: Jul. 30, 1987

[30] Foreign Application Priority Data

Jan. 27, 1986 [FR] France ..... 86 01203

[51] Int. Cl.[4] ..... A47F 5/00

[52] U.S. Cl. ..... 211/59.3; 211/54.1; 211/59.1

[58] Field of Search ..... 211/54.1, 59.3, 51, 211/59.1, 57.1

[56] References Cited

U.S. PATENT DOCUMENTS 2,311,749 2/1943 Hanf .
2,939,619 6/1960 Levesque .
4,475,658 10/1984 Roberts ..... 211/54.1

FOREIGN PATENT DOCUMENTS 2419702 10/1979 France .
2527913 12/1983 France .

*Primary Examiner*—Robert W. Gibson, Jr.
*Attorney, Agent, or Firm*—Cushman, Darby & Cushman

[57] ABSTRACT

The invention pertains to a spring-loaded return mechanism for double-peg displays in self-service shops.

The mechanism comprises: a peg (1), onto which are welded, at the rear and at the front respectively, a cross-piece (2) for hooking on the spring and a cross-piece (3) supporting a 180° return stud (4); a spring (5); and a sliding thrust plate (6).

6 Claims, 2 Drawing Sheets

RETURN SPRING DEVICE FOR DOUBLE PINS OF DISPLAY UNITS

BACKGROUND OF THE INVENTION

1. Field of the Invention

The present invention pertains to a return mechanism for pushing packaged products to the ends of double display pegs in self-service shops.

The use of return mechanisms to allow shoppers to easily identify and remove items or objects suspended from display pegs is well known. In general, these are compressive spring-loaded mechanisms which are guided by the pegs.

2. Background Art

Return mechanisms are commonly employed and we will mention herein those described in the following patents or patent applications:

French patent application FR-A-2 570 151 pertaining to a packaged product return mechanism, comprising essentially a spring made up of alternate coils of two different diameters and guided by one or several rods introduced between the large and small diameter coils, and supporting the item which is pushed to the front.

French Pat. No. FR-A-2 527 913 pertaining to a spring-loaded mechanism designed to push items suspended on a single peg or double pegs frontwards by means of a vertical sliding plate; each peg embodies a spring-type compressive element, stacked up and sliding freely over the peg, the rear end of the element resting on a bush previously slipped onto each peg and the front end of the element fitting into a slide running along on the peg and secured to the plate, which acts as a thrust device.

U.S. Pat. No. 4,475,658 pertaining to a packaged article return mechanism, comprising essentially a tapered compression spring, guided by a peg passing through the coils and supporting the items, which are continually pushed to the front.

The mechanisms described in patents FR-A-2570151 and U.S. Pat. No. 4,475,658 are not capable of exerting a return action on any packet over a significant length on account of the spring layout and, furthermore, they entail the manufacture of special springs.

The patent request FR-A-2.527.913 describes a mechanism of quite complex design that significantly limits the useful length of each peg due to the presence of the spring and of the slide.

The U.S. Pat. No. 2,311,749 describes a hair-pin distributor, comprising several hair-pin support pegs, each of which has a device with a spring in tension (extended) coupled to a cross-piece for pushing the hair-pins continually against a stop at one end of each peg. In order not to reduce the useful length of the pegs, each spring pulls a sliding thrust plate towards the aforesaid stop by means of a 180° return roller mounted on a shaft located beyond the stop.

The spring and its return roller are positioned in a vertical plane parallel to the peg and outside the hair-pin travel; this arrangement increases the overall dimensions of the assembly and, a priori, restricts the useful length.

SUMMARY OF THE INVENTION

The purpose of the present invention is to overcome these drawbacks since, as described in the claims, it solves the difficulties by pushing the bags to the front of the double pegs by means of a simple arrangement not requiring the manufacture of special springs and guiding the packages smoothly along the full length of the aforesaid pegs without any risk of jamming and without increasing the overall size. This is achieved by a layout wherein the return spring and its 180° roller are mounted flat between the two arms of a double peg and within the space delimited by the cutout of the package attachment tab, and wherein the sliding thrust plate is made from a U-shaped metal sheet having edges turned inwards at 90° underneath and edges turned outwards at 90° on the front, thereby transmitting the thrust load onto the packets along the peg axis.

The advantages resulting from this invention consist mainly of the fact that, when shoppers remove a packet off the peg, the return spring pushes the sliding thrust plate and the remaining packets to the nose of the peg, thereby taking up the space so created; and the fact that the size of the sliding plate lugs, spread laterally towards the front, is such that the spring-induced thrust acting on the packets is very uniform, maintaining them exactly perpendicular to the pegs; and the fact that this layout in no way restricts the capacity of the pegs.

Additional characteristics and advantages will be demonstrated in the description below of a return mechanism for packets in accordance with this invention and which is given as a non-exhaustive example.

DESCRIPTION OF THE PREFERRED EMBODIMENTS

Figure 1:
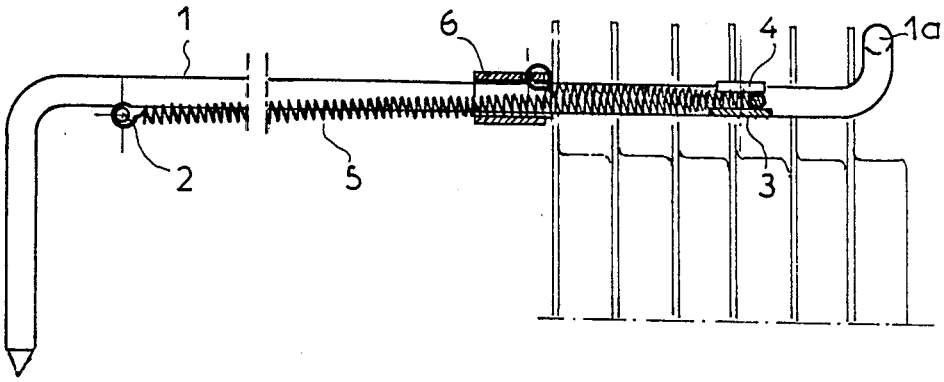
FIG. 1 represents a side view of a longitudinal section of the mechanism mounted on a display peg.

The mechanism according to the invention consists essentially of: the peg 1, under which a spring hook-on cross-piece 5 and a cross-piece 3 are welded respectively at the rear and at the front, a cylindrical stud 4 with a groove **4*a* being attached on top of cross-piece 3 to act as the 180° return point; the spring 5; and the sliding thrust plate 6**.

In pursuance with this invention, one end of the spring 5 is secured onto the cross-piece 2, welded underneath and at the rear of the double peg, and the other end of the spring is attached to the sliding thrust plate 6 by means of the hole **6*a*, after passing around the grooved stud 4 mounted on the cross-piece 3, which is welded on the front of the peg 1 near to the peg nose. The height of the return stud 4 is not greater than the diameter of the arms of the peg 1**.

Figure 2:
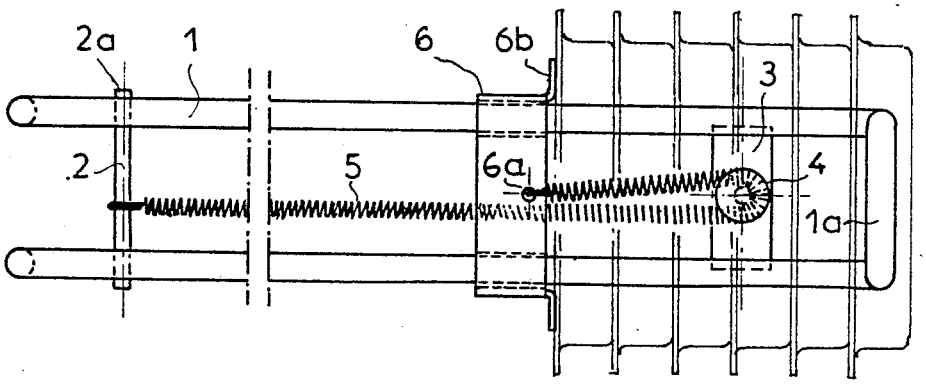
FIG. 2 represents a top view of the mechanism mounted on a peg.

As shown in FIGS. 1 and 2, the spring 5 is hooked onto the sliding thrust plate 6 by means of the hole **6*a*, drilled near the edge on the upper part of the sliding thrust plate 6 in its longitudinal plane of symmetry of the plate. Consequently, the action of the spring 5 on the sliding thrust plate 6 continually pushes the packets towards the nose of the peg 1, which acts as a stop. The packets are kept perpendicular to the peg 1 and the thrust distributed over a sufficient area by providing front-mounted lateral lugs 6*b* on the sliding thrust plate. The spring 5 is retained in its working plane by the undercut groove 4a on the return stud 4**, regardless of the tension exerted on the spring.

The tips 2a of the cross-piece 2, onto which is hooked one end of the spring 5, protrude on both sides of the peg 1 to form stops for the rearward travel of the sliding thrust plate 6, which is held in place on the arms of the double peg 1 by the turned-up edges 6a.

Figure 3:
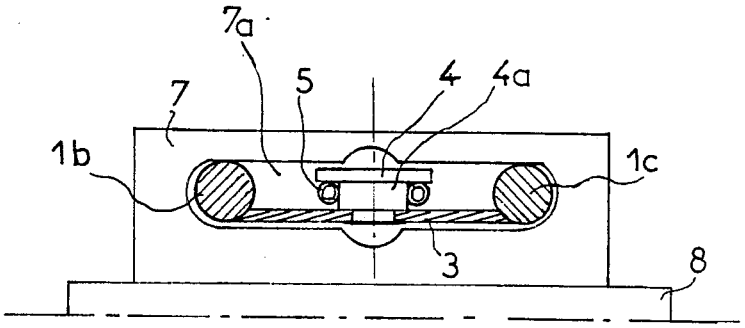
FIG. 3 represents a transverse section of the assembly at the spring return stud.

As indicated in FIG. 3, since the return mechanism is entirely located within the space delimited by the cutout 7a in the tab 7, used for hooking the packets 8 onto the double pegs 1, any packaged article, regardless of its size and with a suspension tab incorporating such a cutout, can be suspended from the pegs. This arrangement is also suitable, without any restrictions, for the display of very large sized packaged goods suspended from several pegs, provided that their tabs feature the corresponding cutouts.

Figure 4:
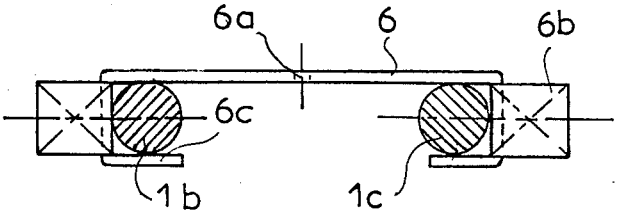
FIG. 4 represents a front view of the sliding thrust plate.

As shown in FIG. 4, the middle transverse plane of the lugs 6b, bent at 90° outwards from the slide 6, coincides with the plane defined by the axes of the two arms 1b and 1c of the double peg 1, an arrangement which produces a thrust on the suspension tabs along the axis of symmetry of the two pegs, thereby always maintaining the tabs 7 perpendicular to the peg 1, regardless of their position on the peg.

I claim:

1. A spring-loaded device for display of articles of the type having means for slidably supporting the article on slide rail means, said device comprising slide rail means having a first end and an opposite, second end with said second end being adapted for attachment to a support, a thrust plate slidably supported on said slide rail means, a return stud carried by said slide rail means at a position adjacent said first end thereof, a cross-piece carried by said slide rail means adjacent said second end thereof, a spring member having a first end attached to said thrust plate and a second end attached to said cross-piece with said spring member extending from said thrust plate, around said return stud to said cross-piece and being attached at its ends to said thrust plate and to said cross-piece, respectively, said slide rail means comprising two arms extending substantially in the same plane, said return stud being disposed between said two arms, said thrust plate comprising a U-shaped metal sheet including a pair of lugs extending outwardly to engage an article supported on said slide rail means to thereby exert thrust loading on the articles tending to move the articles toward said first end.

2. The invention as claimed in claim 1 wherein said return stud comprises a cylindrical stud having a groove with said stud extending on a cross-member that is secured beneath said arms and near said first end.

3. The invention as claimed in claim 1 wherein said cross-piece is attached to said pair of arms.

4. The invention as claimed in claim 1 wherein said thrust plate has a longitudinal plane of symmetry and a portion which, in use, faces upwardly said portion having a hole formed therein in said longitudinal plane of symmetry, said spring being attached in said hole to said thrust plate.

5. A spring-loaded device pursuant to claim 1, wherein the cross-piece (2), onto which is hooked one end of the spring (5), protrudes on both sides of the arms to form a stop for the rearward travel of the sliding thrust plate (6).

6. A spring-loaded device pursuant to claim 2, wherein the height of the stud (4) is not greater than the diameter of said arms of the peg (1).

* * * * *